US011480345B2

(12) United States Patent
Cai et al.

(10) Patent No.: US 11,480,345 B2
(45) Date of Patent: Oct. 25, 2022

(54) AIR CONDITIONER INDOOR UNIT

(71) Applicants: GD MIDEA AIR-CONDITIONING EQUIPMENT CO., LTD., Foshan (CN); MIDEA GROUP CO., LTD., Foshan (CN)

(72) Inventors: Zhicai Cai, Foshan (CN); Wenjun Luo, Foshan (CN); Kuifang Zou, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 553 days.

(21) Appl. No.: 16/497,942

(22) PCT Filed: Aug. 30, 2019

(86) PCT No.: PCT/CN2019/103734
§ 371 (c)(1),
(2) Date: Sep. 26, 2019

(87) PCT Pub. No.: WO2021/003827
PCT Pub. Date: Jan. 14, 2021

(65) Prior Publication Data

US 2021/0356143 A1 Nov. 18, 2021

(30) Foreign Application Priority Data

Jul. 8, 2019 (CN) ..... 201921063077.8

(51) Int. Cl.
*F24F 1/0057* (2019.01)
*F24F 13/20* (2006.01)

(52) U.S. Cl.
CPC ..... *F24F 1/0057* (2019.02); *F24F 13/20* (2013.01); *F24F 2013/205* (2013.01); *F24F 2221/32* (2013.01)

(58) Field of Classification Search
CPC .... F24F 1/0057; F24F 13/20; F24F 2013/205; F24F 2221/32
(Continued)

(56) References Cited

U.S. PATENT DOCUMENTS

2016/0363342 A1 12/2016 Gutch et al.
2017/0138613 A1* 5/2017 Bai ..... F24F 1/0057

FOREIGN PATENT DOCUMENTS

CN 1766431 A 5/2006
CN 204629963 U 9/2015
(Continued)

OTHER PUBLICATIONS

Intellectual Property Office of Korea (IPKR) The Office Action For KR Application No. 10-2019-7028706 dated Nov. 17, 2020 13 Pages (Translation Included ).
(Continued)

*Primary Examiner* — Vivek K Shirsat
(74) *Attorney, Agent, or Firm* — Anova Law Group PLLC

(57) ABSTRACT

An air conditioner indoor unit includes a housing and a chassis connected to the housing. The chassis and the housing form a receiving chamber with an access opening. At least a portion of an inner side surface of a bottom wall of the chassis forms a guiding surface extending to the access opening. The chassis includes an avoidance hole and a resilient member. At least a portion of the resilient member is arranged in the avoidance hole and protrudes from the guiding surface.

16 Claims, 4 Drawing Sheets

(58) Field of Classification Search
USPC ..... 454/233
See application file for complete search history.

(56) References Cited

FOREIGN PATENT DOCUMENTS

| | | | |
|---|---|---|---|
| CN | 106123292 | A | 11/2016 |
| CN | 107036173 | A | 8/2017 |
| CN | 107062397 | A | 8/2017 |
| CN | 206755349 | U | 12/2017 |
| CN | 206817625 | U | 12/2017 |
| EP | 2937642 | A1 | 10/2015 |
| EP | 3279574 | A1 | 2/2018 |
| EP | 3376124 | A1 | 9/2018 |
| JP | S5682413 | U | 11/1979 |
| JP | H09210453 | A | 8/1997 |
| JP | H10141693 | A | 5/1998 |
| JP | 2000171092 | A | 6/2000 |
| JP | 2005133998 | A | 5/2005 |
| JP | 2011089678 | A | 5/2011 |
| JP | 2017215092 | A | 12/2017 |
| KR | 1019950014765 | A | 6/1995 |
| KR | 20010018489 | A | 3/2001 |
| WO | 2018135022 | A1 | 7/2018 |
| WO | 2018155453 | A1 | 8/2018 |
| WO | 2018176616 | A1 | 10/2018 |

OTHER PUBLICATIONS

World Intellectual Property Organization (WIPO) International Search Report and Written Opinion for PCT/CN2019/103734 dated Mar. 31, 2020 21 Pages.
The European Patent Office (EPO) Extended Search Report for EP Application No. 19765632.5.dated Nov. 5, 2020 8 Pages.
Japan Patent Office (JPO) The Notice of Reasons for Refusal For JP Application No. 2019-553929 dated Nov. 2, 2021 10 Pages (Translation Included).
Korean Intellectual Property Office (KIPO) Notification of Reason for Refusal For KR Application No. 10-2019-7028706 dated Jul. 12, 2021 11 Pages (Translation Included ).

* cited by examiner

AIR CONDITIONER INDOOR UNIT

CROSS-REFERENCE TO RELATED APPLICATIONS

This application is a National Stage Entry under 35 U.S.C. § 371 of International Application No. PCT/CN2019/103734, filed on Aug. 30, 2019, which claims priority to and benefits of Chinese Patent Application Serial No. 201921063077.8, titled "Air conditioner indoor unit", filed with the China National Intellectual Property Administration on Jul. 8, 2019, the entire content contents of both of which are incorporated herein by reference.

FIELD

The present disclosure relates to a field of air conditioning technology, and more particularly to an air conditioner indoor unit.

BACKGROUND

In the related art, an air conditioner indoor unit is usually mounted at a high positon in a room, because the fan assembly has a heavy weight, an operator usually needs to support the fan assembly with great effort to prevent the fan assembly from falling down when puts the fan assembly in or takes it out. The fan assembly easily falls down, which causes damages to the fan assembly or the fan assembly hits the operator. The operation is inconvenient with increase of labor intensity for the operator.

SUMMARY

The present disclosure seeks to solve at least one of the problems existing in the related art to at least some extent.

To this end, an objective of the present disclosure is to provide an air conditioner indoor unit, and a fan assembly of the air conditioner indoor unit does not easily fall down.

The air conditioner indoor unit according to an embodiment of the present disclosure including: a housing; a chassis connected to the housing, the chassis and the housing forming a receiving chamber with an access opening, at least a portion of an inner side surface of a bottom wall of the chassis forms a guiding surface, and the guiding surface extending to the access opening; and a fan assembly capable of being put into the receiving chamber along the guiding surface. The chassis includes an avoidance hole and is provided with a resilient member, at least a portion of the resilient member is arranged in the avoidance hole and protrudes from the guiding surface, and the resilient member is used to fix the fan assembly.

With the air conditioner indoor unit according to the embodiment of the present disclosure, the resilient member is provided to limit the position of the fan assembly, and at least a portion of the resilient member is arranged in the avoidance hole, the fan assembly can be prevented from falling down, and it is convenient to mount and dismount the fan assembly, which reduces the operator's labor intensity, ensures the operator's safety, and facilitates thinning the body.

In addition, the air conditioner indoor unit according to the embodiment of the present disclosure can also have the following technical features.

According to an embodiment of the present disclosure, the resilient member is connected to an inner peripheral wall of the avoidance hole and extends along a first direction, and the first direction is a direction along which the fan assembly in the chassis is taken out through the access opening.

According to an embodiment of the present disclosure, the resilient member includes a first connecting portion connected with the inner peripheral wall of the avoidance hole, extending along the first direction, and leaning towards an inside of the receiving chamber; and a second connecting portion connected with the first connecting portion, extending along the first direction, and leaning away from an inner space of the receiving chamber.

According to an embodiment of the present disclosure, the resilient member further includes: a third connecting portion connected between the first connecting portion and the bottom wall of the chassis; and a fourth connecting portion connected with a free end of the second connecting portion. An inner side surface of the third connecting portion and an inner side surface of the fourth connecting portion are normally flush with the guiding surface.

According to an embodiment of the present disclosure, the chassis includes the avoidance hole, and the resilient member is arranged in the avoidance hole; the resilient member has a first end connected to a side of the avoidance hole that is distal from the access opening and a second end extending towards the access opening, the second end of the resilient member is spaced apart from an inner wall surface of the avoidance hole, and the resilient member has a side surface spaced apart from a side surface of the avoidance hole.

According to an embodiment of the present disclosure, a plurality of resilient members are provided at the bottom wall of the chassis, and the plurality of the resilient members are arranged at intervals in a direction perpendicular to the direction along which the fan assembly is put in.

According to an embodiment of the present disclosure, a snap holder is further provided, the snap holder is connected to the housing and adjacent to the access opening, the fan assembly is provided with a snap, the snap is capable of cooperating with the snap holder to fix the fan assembly.

According to an embodiment of the present disclosure, at least a portion of the bottom wall of the chassis recesses towards an inside of the receiving chamber to form a receiving space, and the indoor unit further comprises a supporting member, the supporting member is pivotably connected to the chassis and used to be connected with the chassis by snapping to cover at least a portion of an opening side of the receiving space.

According to an embodiment of the present disclosure, the guiding surface includes a plurality of grooves, and the grooves extend along the direction along which the fan assembly is put in and are arranged at intervals along a direction perpendicular to the direction along which the fan assembly is put in.

Figure 1:
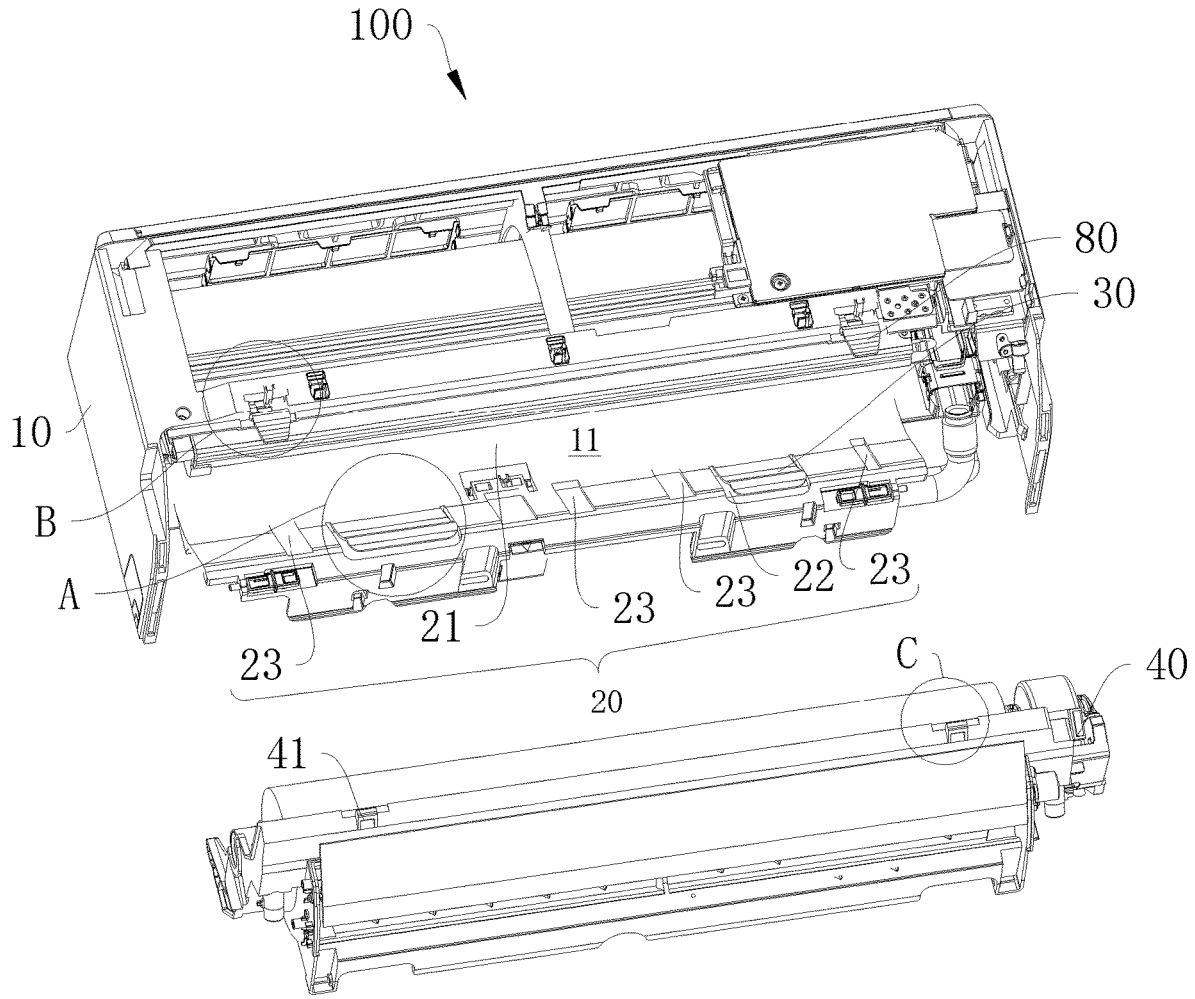
FIG. 1 is a schematic view of an air conditioner indoor unit according to an embodiment of the present disclosure.

REFERENCE NUMERALS air conditioner indoor unit 100, housing 10, receiving chamber 11, chassis 20, guiding surface 21, avoidance hole 22, groove 23, resilient member 30, first connecting portion 31, second connecting portion 32, third connecting portion 33, fourth connecting portion 34, fan assembly 40, snap 41, supporting member 50, connecting duct 60, drain duct 70, snap holder 80.

DETAILED DESCRIPTION

Embodiments of the present disclosure will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present disclosure, but shall not be construed to limit the present disclosure.

An air conditioner indoor unit 100 according to embodiments of the present disclosure is described referring to FIG. 1 to FIG. 6 in the following. The air conditioner indoor unit 100 may be a wall-mounted air conditioner or a ceiling-mounted air conditioner. As illustrated in FIG. 1, the air conditioner indoor unit 100 may generally include a housing 10, a chassis 20, a fan assembly, and a resilient member 30.

Specifically, as illustrated in FIG. 1, the chassis 20 is connected to the housing 10, and the chassis 20 and the housing 10 form a receiving chamber 11 with an access opening. At least a portion of an inner side surface of a bottom wall of the chassis 20 forms a guiding surface 21, and the guiding surface extends to the access opening. The fan assembly is capable of being put into the receiving chamber 11 along the guiding surface 21.

Figure 5:
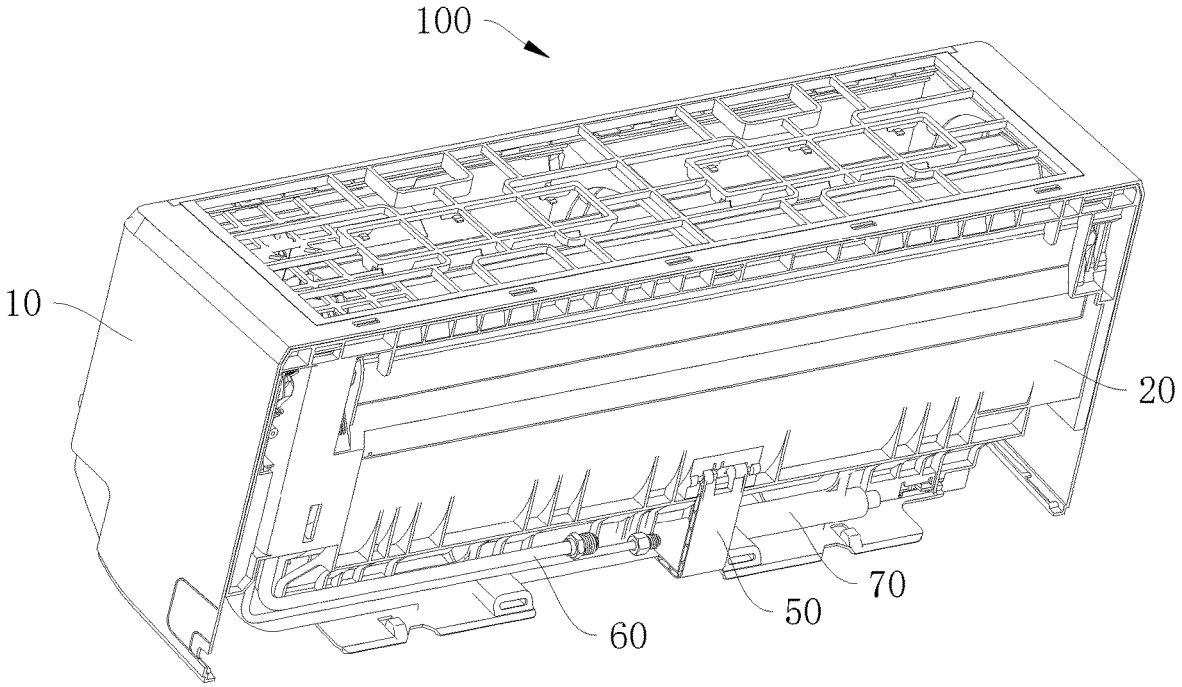
FIG. 5 is a perspective view of an air conditioner indoor unit according to an embodiment of the present disclosure.

As illustrated in FIG. 1 and FIG. 5, the fan assembly 40 is arranged in the receiving chamber 11, and the receiving chamber 11 has the access opening. Therefore, the fan assembly can be checked and maintained through the access opening.

Specifically, when it is needed to mount the fan assembly, the fan assembly 40 is mounted into the receiving chamber 11 along the guiding surface 21. When it is needed to dismount the fan assembly, the fan assembly 40 is taken out through the guiding surface 21. With the guiding surface 21, the fan assembly can be supported and guided, which makes it convenient to mount and dismount the fan assembly 40.

Furthermore, the chassis includes an avoidance hole and is provided with a resilient member, and the resilient member is used to fix the fan assembly. Therefore, with the resilient member 30, the possibility that the fan assembly is damaged or hits an operator in case of falling down can be reduced. Especially, the operator does not need to beware of the falling of the fan assembly all the time when mounting the fan assembly. There is no need to provide support for the fan assembly, thereby reducing the operator's labor intensity and making it convenient to mount.

At least a portion of the resilient member 30 is arranged in the avoidance hole 22 and protrudes from the guiding surface 21. The whole resilient member 30 may be arranged in the avoidance hole 22, or the resilient member 30 may be partially arranged in the avoidance hole 22. The resilient member 30 protrudes from the guiding surface 21, when the fan assembly 40 is mounted, the resilient member is deformed, and a portion of the resilient member that protrudes from the guiding surface moves towards an inner of the avoidance hole. In this way, with the avoidance hole 22, a space can be made for the fan assembly 40 to pass through. A large space for the fan assembly 40 to pass through is not needed, furthermore, thickening the whole body of the air conditioner indoor unit 100 is not needed, the appearance of air conditioner indoor unit 100 in a thickness direction can be ensured.

Therefore, with the air conditioner indoor unit 100 according to the embodiments of the present disclosure, the resilient member 30 is provided to limit the position of the fan assembly, and at least a portion of the resilient member 30 is arranged in the avoidance hole 22, the fan assembly can be convenient to mount, which reduces the operator's labor intensity, ensures the operator's safety, and facilitates thinning the body.

In some embodiments, as illustrated in FIG. 1, the resilient member 30 includes a pre-positioning structure, the pre-positioning structure is arranged on the chassis 20, the pre-positioning structure has a first state and a second state, at least a portion of the pre-positioning structure protrudes towards the inside of the receiving chamber 11 in the first state, the pre-positioning structure in the second state is lower than the pre-positioning structure in the first state, and the pre-positioning structure is configured to normally tend to restore the first state. In other words, the pre-positioning structure in the first state is used to limit the position of the fan assembly. Specifically, the pre-positioning structure is arranged on the chassis 20, and the at least a portion of the pre-positioning structure protrudes towards the inside of the receiving chamber 11 in the first state, therefore, the pre-positioning structure restricts movement of the fan assembly to an air outlet along the guiding surface 21, after the fan assembly is mounted. In this way, the fan assembly can be fixed. The pre-positioning structure in the second state is lower than the pre-positioning structure in the first state, that is in the second state, the pre-positioning structure is used for making room, therefore, the fan assembly can be conveniently put in or taken out through the access opening.

The pre-positioning structure tends to restore the first state, in this way, during mounting the fan assembly, the pre-positioning structure is in the second state, the pre-positioning structure restore the first state itself after mounting to fix the positon of the fan assembly, which reduces mounting steps.

In addition, in the first state, a portion of the pre-positioning structure extends into the receiving chamber 11, or, in the first state, all the pre-positioning structure extends into the receiving chamber 11. For example, in the first state, a portion of the pre-positioning structure protrudes from the chassis 20 and extends towards the receiving chamber 11, and another portion is located in the bottom wall of the chassis 20 or protrudes from an outer surface of the chassis 20.

The pre-positioning structure may be a structure capable of telescoping in a thickness direction of the chassis 20. For example, in the first state the pre-positioning structure extends towards the inside of the receiving chamber 11 along the thickness of the chassis 20, while in the second state, the pre-positioning structure retracts away from the receiving chamber 11 along the thickness of the chassis 20. Certainly, the above embodiments are exemplary and cannot be construed as a limit to the protection scope of the disclosure. For example, the pre-positioning structure may be an elastic structure or the like.

Figure 2:
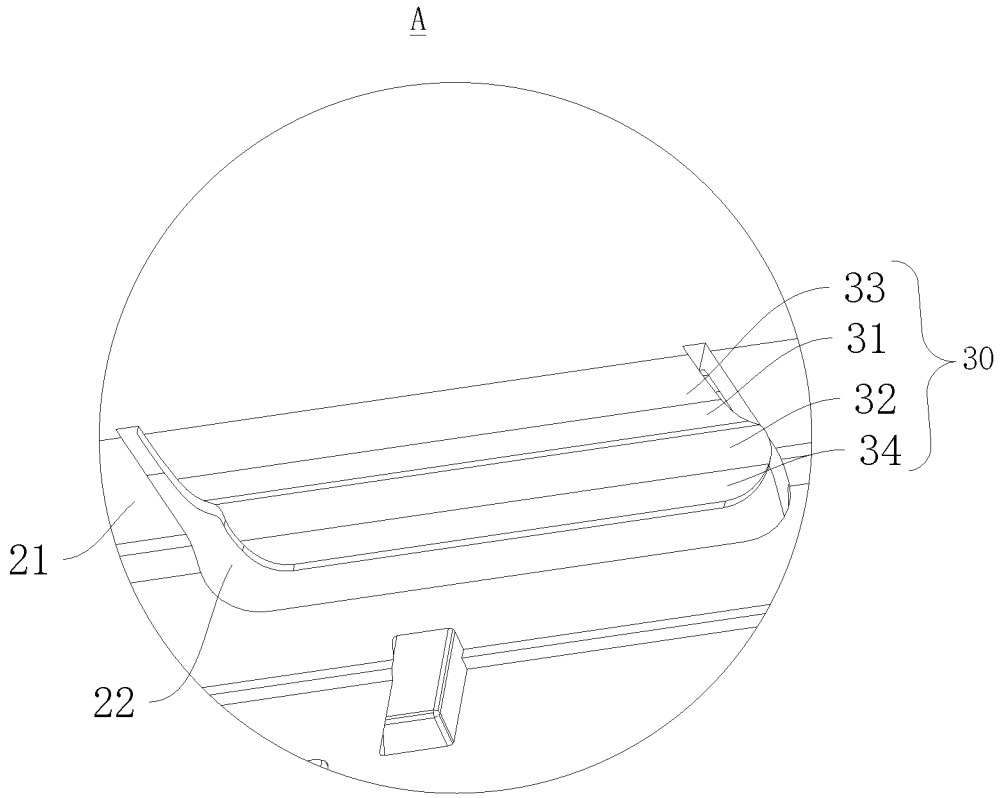
FIG. 2 is an enlarged view of part A in FIG. 1.

In some optional embodiments, as illustrated in FIG. 1 and FIG. 2, the resilient member 30 is connected to an inner peripheral wall of the avoidance hole 22. The resilient member 30 extends along a first direction, and the first direction refers to a direction along which the fan assembly in the chassis 20 is taken out through the access opening. One the one hand, the resilient member 30 tends to restore the first state, therefore, the fan assembly can be automatically fixed in position after mounting. On the other hand, the resilient member 30 extends along the direction along which the fan assembly is taken through the access opening, in the second state, the resilient member 30 can guide and support the fan assembly, enhancing the structural stability of the chassis 20.

Specifically, when the fan assembly is mounted into the receiving chamber 11 through the access opening, the resilient member 30 switches to the second state from the first state, making it convenient to mount the fan assembly, the fan assembly is mounted into the receiving chamber 11 along the guiding surface 21. After the fan assembly reaches a preset position, the resilient member 30 restore to the first state from the second state, the resilient member 30 restricts the fan assembly, i.e. restricts movement of the fan assembly along the guiding surface 21. When the fan assembly is taken out through the access opening, the resilient member 30 switches from the first state to the second state, such that it is convenient to taking the fan assembly out from the receiving chamber 11. After the fan assembly is taken out, the resilient member 30 restores to the first state from the second state. The pre-positioning structure is configured as a resilient member 30, the resilient member 30 may be integrally formed with the chassis 20, thereby simplifying structure and process, and lowing cost.

In some specific embodiments, as illustrated in FIG. 1 and FIG. 2, the resilient member 30 includes a first connecting portion 31 and a second connecting portion 32. The first connecting portion 31 is connected with the inner peripheral wall of the avoidance hole 22, and the first connecting portion 31 extends along the first direction and leans towards the inside of the receiving chamber 11. The second connecting portion 32 is connected to the first connecting portion 31, the second connecting portion 32 extends along the first direction and leans away from the inner space of the receiving chamber 11. Therefore, the first connecting portion 31 leans towards the inside of the receiving chamber 11, that is the first connecting portion 31 protrudes from the inner side surface of the chassis 20 and extends into the receiving chamber 11. In this way, when the fan assembly is mounted into the receiving chamber 11, the fan assembly presses the first connecting portion 31 down to make the first connecting portion 31 in the second state, such that the fan assembly is convenient to be mounted into the receiving chamber 11. After the fan assembly reaches the preset position, the first connecting portion 31 restores to an initial state, i.e., the first connecting portion 31 protrudes from the inner side surface of the chassis 20 at this time, and the first connecting portion 31 can restrict the positon of the fan assembly at this time. When the fan assembly is taken out through the access opening, the first connecting portion 31 also can guide the fan assembly to make it convenient for the fan assembly to press the first connecting portion 31 down, and then the first connecting portion is in the second state. The second connecting portion 32 extends in a direction away from the inner space of the receiving chamber 11, therefore, when the fan assembly is mounted in, the second connecting portion 32 can guide the fan assembly to make it convenient for the fan assembly to press the first connecting portion 31 down, and then the first connecting portion 31 is in the second state.

In a specific embodiment, as illustrated in FIG. 1 and FIG. 2, the resilient member 30 also includes a third connecting portion 33 and a fourth connecting portion 34. The third connecting portion 33 is connected between the first connecting portion 31 and the bottom wall of the chassis 20, and the fourth connecting portion 34 is connected with a free end of the second connecting portion 32. Normally, an inner side surface of the third connecting portion 33 and an inner side surface of the fourth connecting portion 34 are flush with the guiding surface 21. Therefore, both the fourth connecting portion 34 and the third connecting portion 33 can be used for guidance, making it convenient to put in or take out the fan assembly.

Certainly, the above embodiments are exemplary and cannot be construed as a limit to the protection scope of the disclosure. For example, in the first state, both the fourth connecting portion 34 and the third connecting portion 33 are lower than the guiding surface 21. It should be noted that, terms "higher" and "lower" in the present disclosure both refer to comparison along the thickness direction of the chassis 20. For example, an inner surface of the chassis 20 is higher than an outer surface of the chassis 20. In addition, or in the first state, one of the fourth connecting portion 34 and the third connecting portion 33 is flush with the guiding surface 21, and the other one is lower than the guiding surface 21.

In some specific embodiments, as illustrated in FIG. 1 and FIG. 2, the chassis 20 includes the avoidance hole 22, and the resilient member 30 is arranged in the avoidance hole 22. The resilient member 30 has a first end connected to a side of the avoidance hole 22 that is distal from the access opening and a second end extending towards the access opening. The second end of the resilient member 30 is spaced apart from an inner wall surface of the avoidance hole 22, and the resilient member 30 has a side surface spaced apart from a side surface of the avoidance hole 22. Therefore, the avoidance hole 22 can be used for making room, making it convenient for the resilient member 30 to switch between the first state and the second state. In addition, with the avoidance hole 22, material can be saved and cost can be lowered.

Certainly, the above embodiments are exemplary and cannot be construed as a limit to the protection scope of the disclosure. For example, the chassis 20 can further include an avoidance groove, the resilient member 30 is arranged in the avoidance groove. The resilient member 30 has a first end connected to a side of the avoidance groove that is distal from the access opening and a second end extending towards the access opening. The second end of the resilient member 30 is higher than the guiding surface 21 of the chassis 20. Therefore, avoidance can be achieved and the structural strength of the chassis 20 can be enhanced.

Figure 6:
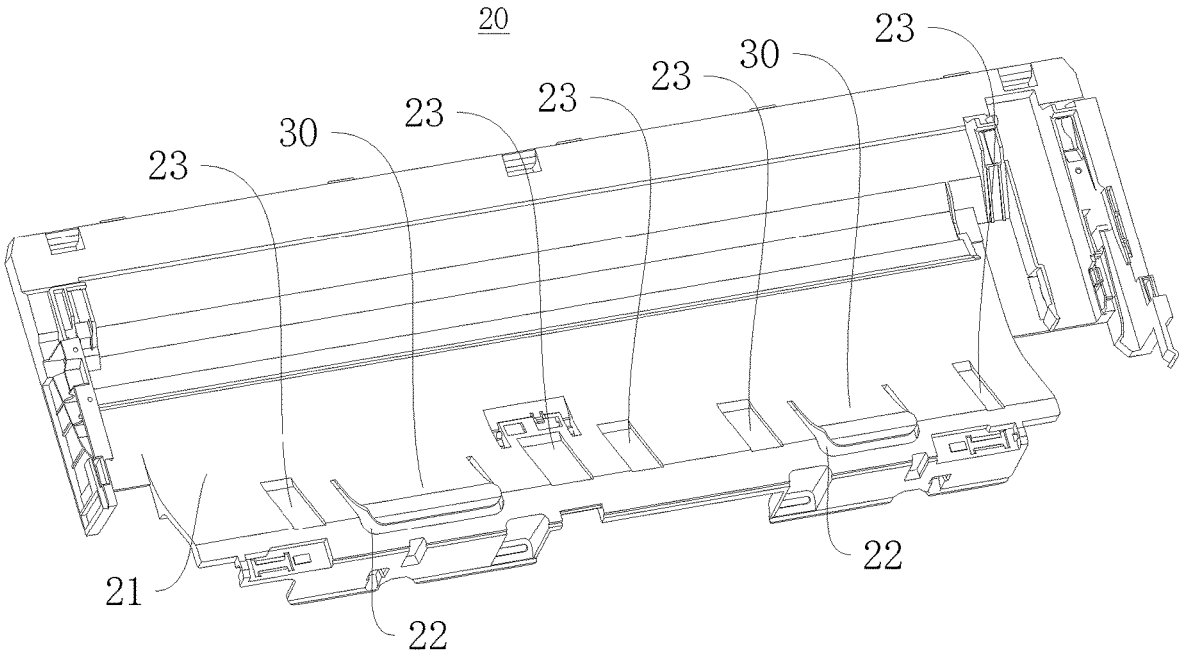
FIG. 6 is a perspective view of a chassis according to an embodiment of the present disclosure.

In some embodiments, as illustrated in FIG. 1 and FIG. 6, the bottom of the chassis 20 is provided with a plurality of resilient members 30, and the plurality of the resilient members 30 are arranged at intervals in a direction perpendicular to the direction along which the fan assembly is put in. Therefore, with the plurality of resilient members 30, the plurality of resilient members 30 cooperatively fix the position of the fan assembly together, such that the fan assembly can be stably positioned. The plurality of resilient members 30 may extend along the same direction or opposite directions, as long as the resilient members 30 can position the fan assembly in the first state. For example, the bottom of the chassis 20 includes three resilient members 30 along a length direction at intervals, two resilient members 30 extends along the direction along which the fan assembly is taken out, and the other one resilient member 30 extends along the direction along which the fan assembly is put in.

Certainly, the above embodiments cannot be construed as a limit to the protection scope of the disclosure. For example, the plurality of resilient members 30 may arranged at the interval along the direction along which the fan assembly is put in.

Figure 3:
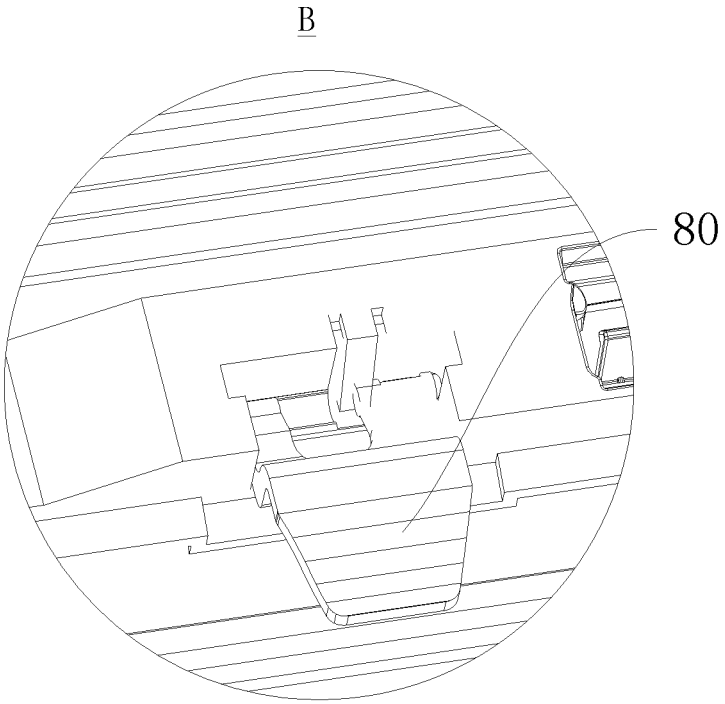
FIG. 3 is an enlarged view of part B in FIG. 1.
Figure 4:
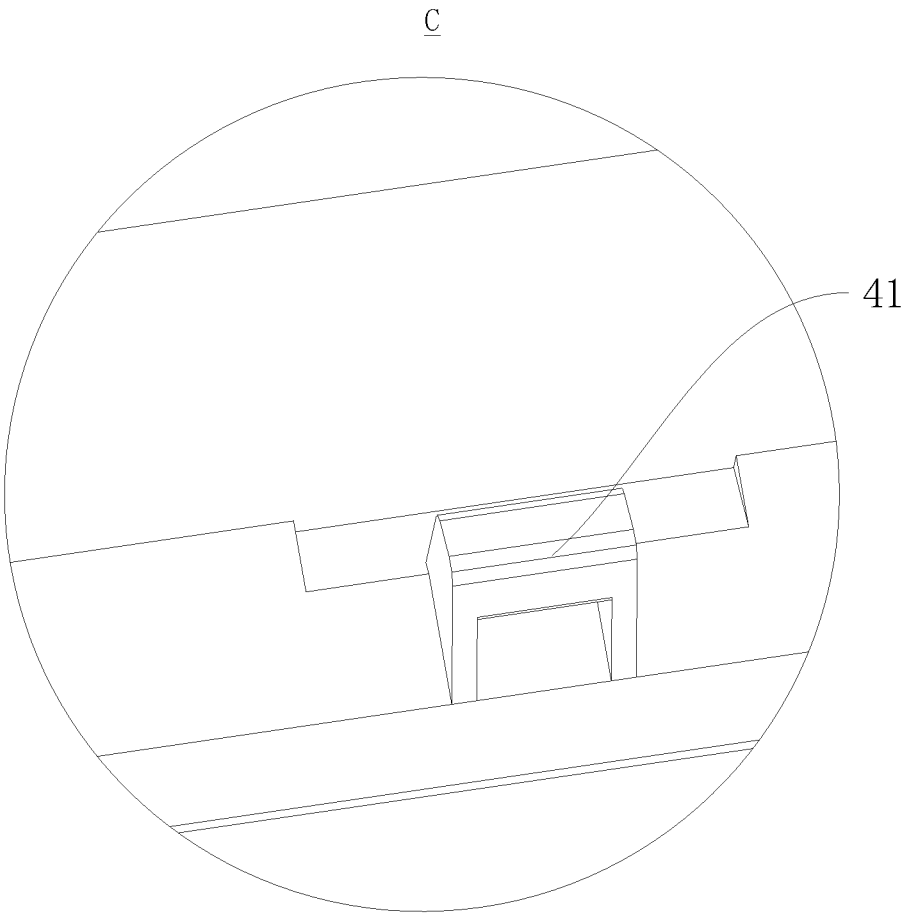
FIG. 4 is an enlarged view of part C in FIG. 1.

In some embodiments, as illustrated in FIG. 1, FIG. 3 and FIG. 4, a snap holder 80 is further provided, the snap holder 80 is connected to the housing 10 and adjacent to the access opening. The fan assembly is provided with a snap 41, the snap 41 can cooperate with the snap holder 80 to fix the fan assembly. With the snap holder 80 and the snap 41, the position of the fan assembly can be further fixed, enhancing the mounting stability of the fan assembly. After the fan assembly is mounted in the receiving chamber 11, the pre-positioning structure can pre-position the fan assembly, and then the fan assembly can be stably mounted in the receiving chamber 11 via cooperation between the snap holder 80 and the snap 41.

In some optional embodiments, the snap holder 80 has an end rotatably connected to the housing 10. Therefore, the snap holder 80 releases cooperation with the snap 41 by rotation, which makes it convenient to position and release the fan assembly.

In some embodiments, as illustrated in FIG. 1 and FIG. 6, at least a portion of the bottom wall of the chassis 20 is recessed towards the inside of the receiving chamber 11 to form a receiving space. Therefore, the outer surface of the bottom wall recesses inwards to form the receiving space, and the inner surface of the bottom wall forms as the guiding surface 21 used when the fan assembly is put in. A drain duct 70 or a connecting duct 60 or the like can be mounted in the receiving space, which increases the space utilization of the air conditioner indoor unit 100.

As illustrated in FIG. 5, the air conditioner indoor unit 100 further includes a supporting member 50, the supporting member 50 is pivotably connected to the chassis 20, and the supporting member 50 used to be connected with the chassis 20 by snapping to cover at least a portion of an opening side of the receiving space. The supporting member 50 is pivotably connected to the chassis 20, therefore, when the air conditioner indoor unit 100 is mounted, the supporting member 50 is rotated and opened, the supporting member 50 has a first end abutting against a wall and a second end supporting the chassis 20, thereby supporting the body to move away from the wall. The operator can conveniently mount the drain duct 70 or the like. When a support frame is snapped, the supporting member 50 covers the drain duct 70, thereby positioning the drain duct 70.

In some embodiments, as illustrated in FIG. 1 and FIG. 6, the guiding surface 21 includes a plurality of grooves 23, the grooves 23 extend along the direction along which the fan assembly is put in, and the plurality of grooves 23 are arranged at intervals along a direction perpendicular to the direction along which the fan assembly is put in. With the plurality of grooves 23, the structural strength of the chassis 20 is enhanced and the stability of the chassis 20 is improved.

In some embodiments, as illustrated in FIG. 1, snapping portions of the supporting member 50 and the chassis 20 are distal from the access opening, therefore, the possibility that the supporting member 50 hangs on the fan assembly can be reduced when the fan assembly is taken out.

In the description of the present disclosure, it should be understood that, terms such as "thickness", "upper", and "lower", etc. should be construed to refer to the orientation as then described or as shown in the drawings under discussion. These relative terms are for convenience of description and do not require that the present disclosure be constructed or operated in a particular orientation. Therefore, the above terms should not be construed to limit the present disclosure.

In addition, terms such as "first" and "second" are used herein for purposes of description and are not intended to indicate or imply relative importance or implicitly indicate the number of the feature associated with the term. Thus, the feature associated with "first" and "second" may explicitly or implicitly comprise one or more this feature. In the description of the present disclosure, term "a plurality of" means at least two, such as two, three, etc., unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An air conditioner indoor unit, comprising:

a housing; and a chassis connected to the housing;

wherein:

the chassis and the housing form a receiving chamber with an access opening;

at least a portion of an inner side surface of a bottom wall of the chassis forms a guiding surface extending to the access opening;

the chassis includes an avoidance hole and a plurality of resilient members provided at the bottom wall of the chassis, at least a portion of one resilient member of the plurality of resilient members being arranged in the avoidance hole and protruding from the guiding surface.

2. The indoor unit according to claim 1, wherein the one resilient member is connected to an inner peripheral wall of the avoidance hole and extends along an assembling direction of the access opening from outside the receiving chamber to inside the receiving chamber through the access opening.

3. The indoor unit according to claim 2, wherein the one resilient member comprises:

a first connecting portion connected with the inner peripheral wall of the avoidance hole, extending along the assembling direction, and leaning towards an inside of the receiving chamber; and a second connecting portion connected with the first connecting portion, extending along the assembling direction, and leaning away from the inside of the receiving chamber.

4. The indoor unit according to claim 3, wherein:

the one resilient member further comprises:

a third connecting portion connected between the first connecting portion and the bottom wall of the chassis; and a fourth connecting portion connected with a free end of the second connecting portion; and an inner side surface of the third connecting portion and an inner side surface of the fourth connecting portion are flush with the guiding surface in a normal state without external force.

5. The indoor unit according to claim 1, wherein the one resilient member includes:

a first end connected to a side of the avoidance hole that is distal from the access opening; and a second end extending towards the access opening and being spaced apart from an inner wall surface of the avoidance hole.

6. The indoor unit according to claim 1, wherein a side surface of the one resilient member is spaced apart from a side surface of the avoidance hole.

7. The indoor unit according to claim 1, wherein the plurality of resilient members are arranged at intervals in an assembling direction of the access opening from outside the receiving chamber to inside the receiving chamber through the access opening.

8. The indoor unit according to claim 1, wherein the plurality of resilient members are arranged at intervals in a direction perpendicular to an assembling direction of the access opening from outside the receiving chamber to inside the receiving chamber through the access opening.

9. The indoor unit according to claim 1, wherein an extension direction of one of the plurality of resilient members is opposite to an extension direction of another one of the plurality of resilient members.

10. The indoor unit according to claim 1, further comprising:

a fan assembly configured to be inserted into and removed from the receiving chamber along the guiding surface through the access opening.

11. The indoor unit according to claim 10, further comprising:

a snap holder connected to the housing and adjacent to the access opening;

wherein the fan assembly includes a snap configured to cooperate with the snap holder to fix the fan assembly when the fan assembly is in the receiving chamber.

12. The indoor unit according to claim 1, further comprising:

a supporting member, one part of the supporting member being pivotably connected to the chassis and another part of the supporting member being configured to be snapped with the chassis.

13. The indoor unit according to claim 12, wherein:

at least a portion of the bottom wall of the chassis is recessed towards an inside of the receiving chamber to form a receiving space; and the supporting member is configured to cover at least a portion of an opening side of the receiving space when being snapped with the chassis.

14. The indoor unit according to claim 13, further comprising:

one or more ducts mounted in the receiving space;

wherein the supporting member is further configured to cover the one or more ducts when being snapped with the chassis.

15. The indoor unit according to claim 14, wherein the one or more ducts include at least one of a drain duct or a connecting duct.

16. The indoor unit according to claim 1, wherein the guiding surface includes a plurality of grooves extending along an assembling direction of the access opening from outside the receiving chamber to inside the receiving chamber through the access opening and arranged at intervals along a direction perpendicular to the assembling direction.

* * * * *